US009562494B2

(12) United States Patent
Krenn

(10) Patent No.: US 9,562,494 B2
(45) Date of Patent: Feb. 7, 2017

(54) INTERNAL COMBUSTION ENGINE HAVING A SPLIT CRANKCASE

(71) Applicant: BRP-POWERTRAIN GMBH & CO. KG, Gunskirchen (AT)

(72) Inventor: Stefan Krenn, Linz (AT)

(73) Assignee: BRP-POWERTRAIN GMBH & CO. KG, Gunskirchen (AT)

( * ) Notice: Subject to any disclaimer, the term of this patent is extended or adjusted under 35 U.S.C. 154(b) by 0 days.

(21) Appl. No.: 14/423,373

(22) PCT Filed: Jan. 31, 2014

(86) PCT No.: PCT/IB2014/058710

§ 371 (c)(1),
(2) Date: Feb. 23, 2015

(87) PCT Pub. No.: WO2014/118746

PCT Pub. Date: Aug. 7, 2014

(65) Prior Publication Data

US 2016/0003185 A1 Jan. 7, 2016

Related U.S. Application Data

(60) Provisional application No. 61/758,853, filed on Jan. 31, 2013.

(51) Int. Cl.
*F02F 7/00* (2006.01)
*F02B 61/02* (2006.01)
(Continued)

(52) U.S. Cl.
CPC ..... *F02F 7/0002* (2013.01); *F01B 1/12* (2013.01); *F02B 61/02* (2013.01); *F02F 1/24* (2013.01);
(Continued)

(58) Field of Classification Search
CPC ..... F02F 7/0002; F02F 1/24; F02F 7/0007; F02F 7/0004; F02F 7/00; F02F 7/0053
See application file for complete search history.

(56) References Cited

U.S. PATENT DOCUMENTS 1,135,524 A 4/1915 Hewitt
1,321,923 A 11/1919 Knox
(Continued)

FOREIGN PATENT DOCUMENTS

DE 2044943 A1 3/1972
EP 0597263 A1 5/1994
(Continued)

OTHER PUBLICATIONS

International Search Report of PCT/IB2014/058710; Jun. 23, 2014; Luta Dragos.
(Continued)

*Primary Examiner* — Jacob Amick
(74) *Attorney, Agent, or Firm* — BCF LLP

(57) ABSTRACT

An internal combustion engine has a crankcase having a first crankcase portion fastened to a second crankcase portion along a first plane, a crankshaft, a cylinder block defining two cylinders, two pistons, and a cylinder head. A crankshaft support defines a crankshaft support aperture. A central portion of the crankshaft is received in the crankshaft support aperture. At least one fastener fastens the crankshaft support to the cylinder block. The at least one fastener is perpendicular to a crankshaft axis and is disposed in a second plane. The crankshaft axis is normal to the first plane. The second plane is one of coplanar with and parallel to the first plane.

20 Claims, 7 Drawing Sheets

(51) Int. Cl.

| | |
|---|---|
| ***F01B 1/12*** | (2006.01) |
| ***F02F 1/24*** | (2006.01) |
| *F02B 75/18* | (2006.01) |

(52) U.S. Cl.
CPC ..... *F02F 7/0053* (2013.01); *F02B 2075/1808* (2013.01); *F02F 7/0007* (2013.01); *F02F 7/0039* (2013.01); *F02F 2007/0041* (2013.01); *F02F 2007/0063* (2013.01)

(56) References Cited

U.S. PATENT DOCUMENTS

| | | | | |
|---|---|---|---|---|
| 1,423,365 | A | 7/1922 | Smith | |
| 1,457,115 | A | 5/1923 | Leipert | |
| 1,560,927 | A | 11/1925 | Wolf | |
| 2,084,670 | A | 6/1937 | Crittenden | |
| 2,169,236 | A | 8/1939 | Frazier | |
| 2,491,630 | A | 12/1949 | Voorhies | |
| 2,539,132 | A | 1/1951 | Harper | |
| 2,706,972 | A | 4/1955 | Kiekhaefer | |
| 2,781,034 | A | 2/1957 | Herschmann | |
| 3,060,902 | A | 10/1962 | Hoenick | |
| 3,301,237 | A | 1/1967 | Wolf | |
| 3,395,679 | A | 8/1968 | Christner | |
| 6,196,181 | B1 | 3/2001 | Pong | |
| 6,923,091 | B2 | 8/2005 | Hori et al. | |
| 7,089,905 | B2 | 8/2006 | Tsutsumi et al. | |
| 8,136,500 | B2 | 3/2012 | Ochiai et al. | |
| 8,245,683 | B2 | 8/2012 | Taki et al. | |
| 2002/0027032 | A1 | 3/2002 | Tsutsumikoshi | |
| 2003/0209220 | A1 | 11/2003 | Hojyo | |
| 2012/0073537 | A1* | 3/2012 | Oltmans ..... | F01L 1/02 123/195 R |

FOREIGN PATENT DOCUMENTS

| | | | |
|---|---|---|---|
| JP | S63143367 | A | 6/1988 |
| JP | H11270401 | A | 10/1999 |
| JP | 2004044586 | A | 2/2004 |

OTHER PUBLICATIONS

English abstract of JPS63143367; retrieved from http://worldwide.espacenet.com/ on Feb. 23, 2015.
English translation of DE2044943; retrieved from http://worldwide.espacenet.com/ on Feb. 23, 2015.
English abstract of JP2004044586; retrieved from http://worldwide.espacenet.com/ on Sep. 8, 2015.
English abstract of JPH11270401; retrieved from http://worldwide.espacenet.com/ on Sep. 8, 2015.
Consolidated Motor Spares B.V.; Crankcase Schematic Honda CB125T (South Africa); Netherlands; retrieved from http://www.cmsnl.com/honda-cb125t-south-africa_model16532/partslist/E13.html on Sep. 8, 2015.
Consolidated Motor Spares B.V.; Crankshaft-Piston Schematic Honda CB125T (South Africa); Netherlands; retrieved from http://www.cmsnl.com/honda-cb125t-south-africa_model16532/partslist/E12.html#results on Sep. 8, 2015.
Auto Union A-G; DKW NZ500 Repair Manual; Cover page and pp. 1-3, 26-27 and 30-31; Chemnitz; 1944; retrieved from http://www.klassiekrijden.nu/techniek/dkw/dkw-instandsetzungsanweisung-vorkrieg.pdf on Sep. 8, 2015.
Auto Union A-G; DKW Parts list Model NZ500; Cover pages and pp. 1-3 and 10-11; Chemnitz; retrieved from http://www.klassiekrijden.nu/techniek/dkw/dkw-1939-1940-nz500-ersatzteil-liste.pdf on Sep. 8, 2015.
Associated Motor Cycles Ltd.; Instruction Book—Spingtwins; Cover page and p. 19; London; England; retrieved from http://www.klassiekrijden.nu/techniek/ajs-1962-instruction.pdf on Sep. 8, 2015.
Motor Presse Stuttgart GmbH & Co. KG; Motorrad Classic—Foto-Show: Restaurierung Horex-Gespann; Picture 10/14; retrieved form http://www.motorradonline.de/motorraeder/foto-show-restaurierung-horex-gespann/409136?#10 on Sep. 8, 2015.
Motor Presse Stuttgart GmbH & Co. KG; Motorrad Classic—Foto-Show: Restaurierung Horex-Gespann; Picture 11/14; retrieved form http://www.motorradonline.de/motorraeder/foto-show-restaurierung-horex-gespann/409136?#11 on Sep. 8, 2015.
MZ-B Vertriebs GmbH; Catalog Online Jawa 638/639; 2008; Germany; retrieved form http://mz-b.info/638/638-g3.htm on Sep. 8, 2015.

* cited by examiner

INTERNAL COMBUSTION ENGINE HAVING A SPLIT CRANKCASE

CROSS-REFERENCE

The present application claims priority to U.S. Provisional Patent Application No. 61/758,853, filed Jan. 31, 2013, the entirety of which is incorporated herein by reference.

TECHNICAL FIELD

The present technology relates to internal combustion engines having a split crankcase.

BACKGROUND

In many internal combustion engines, in order to facilitate manufacturing, the engine casing is made of multiple components that are then fastened to each other. One of these components is the crankcase which, amongst other things, houses and supports the crankshaft for rotation therein.

One method of manufacturing the crankcase is casting. In order to facilitate the casting, the crankcase is typically made of two or more parts that are then fastened to each other. In crankcase made of two parts, the crankcase can be split along a plane containing the crankshaft axis, such as a horizontal plane, or along a plane that is perpendicular to the crankshaft axis. The latter provides some advantages with respect to the casting of the two portions of the crankcase.

Splitting the crankcase along a plane that is perpendicular to the crankshaft is often used for single cylinder engine as each portion of the crankcase forms one of the two supports necessary to support the crankshaft.

However, splitting the crankcase along a plane that is perpendicular to the crankshaft in a two-cylinder engine is more problematic. The plane along which the crankcase is split is preferably between the two cylinders. As such, the crankcase is split along the position where the crankshaft should be supported in the crankcase between the two cylinders.

In low power engines, one design consists in leaving the central portion of the crankshaft unsupported, and if necessary, providing a stiffer crankshaft to prevent crankshaft deformation. However, in high power engines, the crankshaft has to be supported between the two cylinders.

One solution consists in providing a separate central crankshaft support that is fastened to one of the two crankcase portions before fastening the two portions to each other. The fasteners are inserted perpendicularly to the plane along which the crankshaft portions are split (i.e. parallel to the crankshaft axis). Although this provides a support for the central portion of the crankshaft, it also causes torques to be applied to the crankcase. These torques are caused by forces transferred from the crankshaft to the crankshaft support during operation of the engine.

There is therefore a need for an internal combustion engine having a crankcase that is split along a plane that is perpendicular to the crankshaft and which provides support to a central portion of the crankshaft while limiting the torque being applied to the crankcase as a result of force transfer from the crankshaft.

SUMMARY

It is an object of the present technology to ameliorate at least some of the inconveniences present in the prior art.

In one aspect, embodiments of the present technology provide an internal combustion engine having a crankcase having a first crankcase portion fastened to a second crankcase portion. The first crankcase portion is joined to the second crankcase portion along a first plane. The first crankcase portion has a first wall defining a first crankshaft support aperture. The second crankcase portion has a second wall defining a second crankshaft support aperture. A crankshaft has a first end portion, a second end portion and a central portion. The crankshaft is rotatably supported inside the crankcase. The crankshaft is rotatable about a crankshaft axis. The crankshaft axis being normal to the first plane. The first end portion is received in the first crankshaft support aperture. The second end portion is received in the second crankshaft support aperture. A cylinder block is fastened to the crankcase. The cylinder block defines two cylinders. Each of the two cylinders has a cylinder axis. Two pistons are operatively connected to the crankshaft. The two pistons are disposed in the two cylinders. A cylinder head is fastened to the cylinder block. The cylinder block is disposed between the cylinder head and the cylinder block. A crankshaft support defines a third crankshaft support aperture. The third crankshaft support aperture is coaxial with the first crankshaft support aperture, the second crankshaft aperture and the crankshaft axis. The central portion of the crankshaft is received in the third crankshaft support aperture. At least one fastener fastens the crankshaft support to the cylinder block. The at least one fastener is perpendicular to the crankshaft axis and is disposed in a second plane. The second plane is one of coplanar with and parallel to the first plane.

In a further aspect, the at least one fastener fastens the crankshaft support to the cylinder block and the cylinder head.

In an additional aspect, the at least one fastener is parallel to a third plane, the third plane containing the cylinder axes and the crankshaft axis.

In a further aspect, the at least one fastener is two fasteners disposed on both sides of a third plane, the third plane containing the cylinder axes and the crankshaft axis.

In an additional aspect, the first plane is disposed between the two cylinders.

In a further aspect, the second plane is disposed between the two cylinders.

In an additional aspect, the second plane is coplanar with the first plane.

In a further aspect, a first bearing is disposed between the first end portion of the crankshaft and the first crankshaft support aperture. A second bearing is disposed between the second end portion of the crankshaft and the second crankshaft support aperture. A third bearing is disposed between the central portion of the crankshaft and the third crankshaft support aperture.

In an additional aspect, the second plane passes through a center of the third bearing.

In a further aspect, at least one lubrication passage is defined in the crankshaft support.

In an additional aspect, the crankshaft support defines at least one spray aperture fluidly communicating with the at least one lubrication passage. The at least one spray aperture is adapted to spray lubricant on a least one of the two pistons.

In a further aspect, the crankshaft support has a first part defining a portion of the third crankshaft support aperture and a second part defining another portion of the third crankshaft support aperture. The first part is fastened to the second part.

In an additional aspect, the at least one fastener is at least one first fastener. At least one second fastener fastens the first part to the second part. The at least one second fastener is perpendicular to the crankshaft axis and is disposed in the second plane.

In a further aspect, the first part is disposed between the second part and the cylinder block. The at least one second fastener is inserted through the second part and into the first part.

In an additional aspect, the at least one first fastener is inserted into the first part and is not inserted into the second part.

In a further aspect, the at least one second fastener is parallel to a third plane. The third plane contains the cylinder axes and the crankshaft axis.

In an additional aspect, the at least one first fastener is parallel to the third plane.

In a further aspect, the at least one first fastener is two first fasteners disposed on both sides of the third plane. The at least one second fastener is two second fasteners disposed on both sides of the third plane. The two second fasteners are closer to the third plane than the two first fasteners.

In an additional aspect, the at least one second fastener is two fasteners disposed on both sides of the third crankshaft support aperture.

In a further aspect, the first crankcase portion defines a first counterbalance shaft support aperture in the first wall. The second crankcase portion defines a second counterbalance shaft support aperture in the second wall. The crankshaft support defines a third counterbalance shaft support aperture. A counterbalance shaft has a first end portion, a second end portion and a central portion. The counterbalance shaft is rotatably supported inside the crankcase. The first end portion of the counterbalance shaft is received in the first counterbalance shaft support aperture. The second end portion of the counterbalance shaft is received in the second counterbalance shaft support aperture. The central portion of the counterbalance shaft is received in the third counterbalance shaft support aperture.

In an additional aspect, the counterbalance shaft is a first counterbalance shaft. The first crankcase portion defines a fourth counterbalance shaft support aperture in the first wall. The second crankcase portion defines a fifth counterbalance shaft support aperture in the second wall. The crankshaft support defines a sixth counterbalance shaft support aperture. A second counterbalance shaft has a first end portion, a second end portion and a central portion. The second counterbalance shaft is rotatably supported inside the crankcase. The first end portion of the second counterbalance shaft is received in the fourth counterbalance shaft support aperture. The second end portion of the second counterbalance shaft is received in the fifth counterbalance shaft support aperture. The central portion of the second counterbalance shaft is received in the sixth counterbalance shaft support aperture.

In a further aspect, the first and second counterbalance shafts are disposed on opposite sides of the third plane.

In an additional aspect, the crankshaft support has first, second and third parts. The first part defines a portion of the third crankshaft support aperture, a portion of the third counterbalance shaft support aperture, and a portion of the sixth counterbalance shaft support aperture. The second part defines another portion of the third crankshaft support aperture, and another portion of the third counterbalance shaft support aperture. The third part defines another portion of the sixth counterbalance shaft support aperture. The first part is fastened to the second part and the first part is fastened to the third part.

In a further aspect, the at least one fastener is at least one first fastener. At least one second fastener fastens the crankshaft support to the first crankcase portion. The at least one second fastener is parallel to the crankshaft axis.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
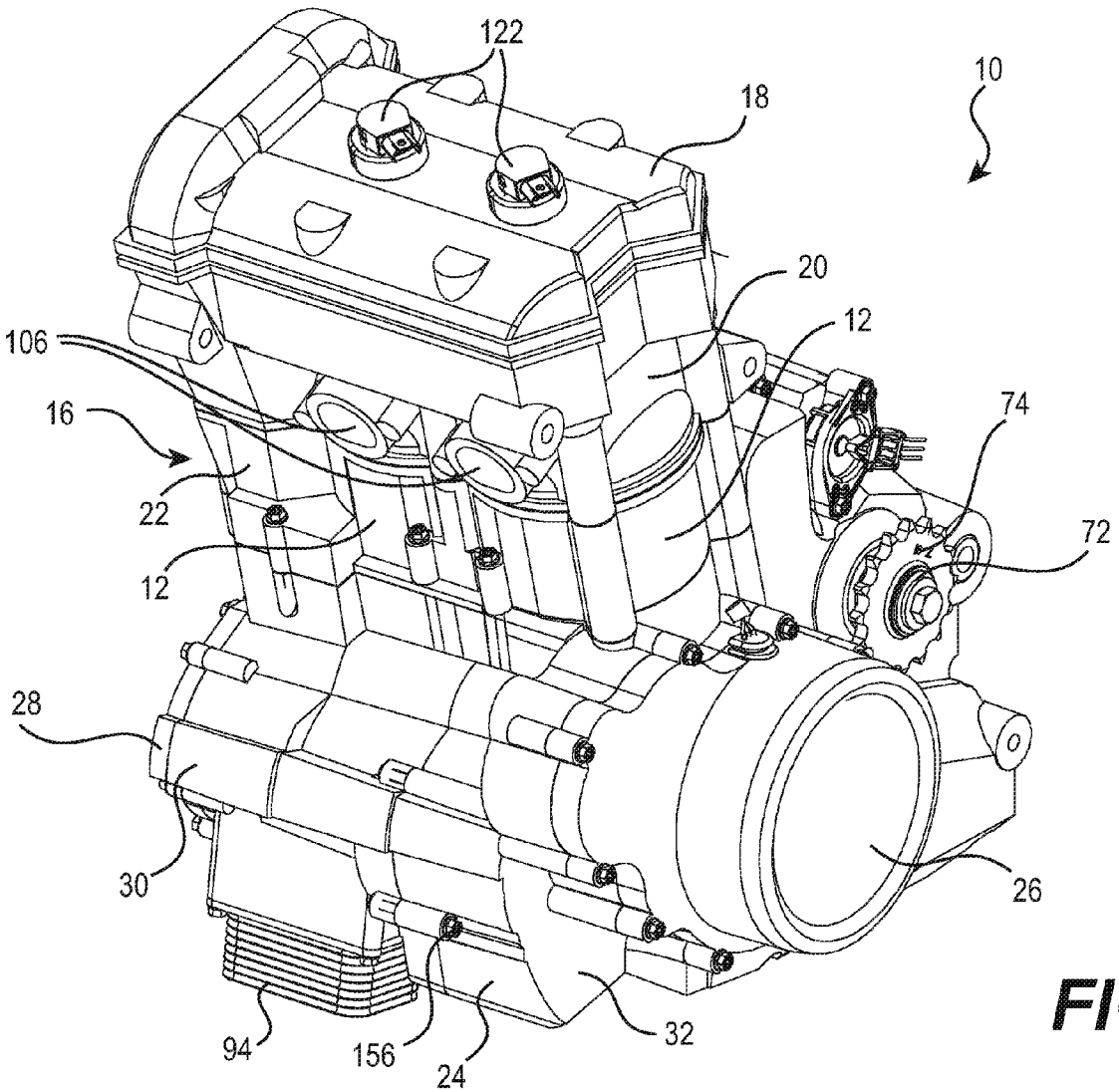
FIG. 1 is a perspective view of an internal combustion engine.

The present technology will be described with respect to a four-stroke, in line, two-cylinder internal combustion engine. However, it is contemplated that aspects of the present technology could be applied to other types of engines, such as, for example, a two-stroke engine.

An internal combustion engine 10 will be described with respect to FIGS. 1 to 7. The engine 10 has two cylinders 12 disposed in line. As such, the central axes 14 of the cylinders 12 are aligned and parallel to each other. The engine 10 has an engine casing 16 made of multiple parts. The engine casing 16 includes a cylinder head cover 18, a cylinder head 20, a cylinder block 22, a crankcase 24, a magneto cover 26 and a clutch cover 28. The cylinder head cover 18, the cylinder head 20, the cylinder block 22, the crankcase 24, the magneto cover 26 and the clutch cover 28 are made of cast aluminum, but it is contemplated that different materials and manufacturing methods could be used. The crankcase 24 is made of two crankcase portions 30, 32 as will be described in greater detail below. The cylinder head cover 18 is fastened to the cylinder head 20. The cylinder head 20 is disposed between the cylinder head cover 18 and the cylinder block 22. The cylinder block 22 is disposed between the cylinder head 20 and the crankcases 24. Two threaded fasteners 34 (FIG. 4) are fastened into apertures formed in the cylinder head 20, the cylinder block 22 and the crankcase portion 30, thereby fastening the cylinder head 20, the cylinder block 22 and the crankcase portion 30 to each other. Two threaded fasteners 36 (FIG. 4) are fastened into apertures formed in the cylinder head 20, the cylinder block 22 and the crankcase portion 32, thereby fastening the cylinder head 20, the cylinder block 22 and the crankcase portion 32 to each other. Two threaded fasteners 38 (FIGS. 3 and 4) are fastened into apertures formed in the cylinder head 20, the cylinder block 22 and a crankshaft support 40, thereby fastening the cylinder head 20, the cylinder block 22 and the crankshaft support 40 to each other. The crankshaft support 40 will be described in more detail below. The magneto cover 26 is fastened to the crankcase portion 32. The clutch cover 28 is fastened to the crankcase portion 30.

Figure 2:
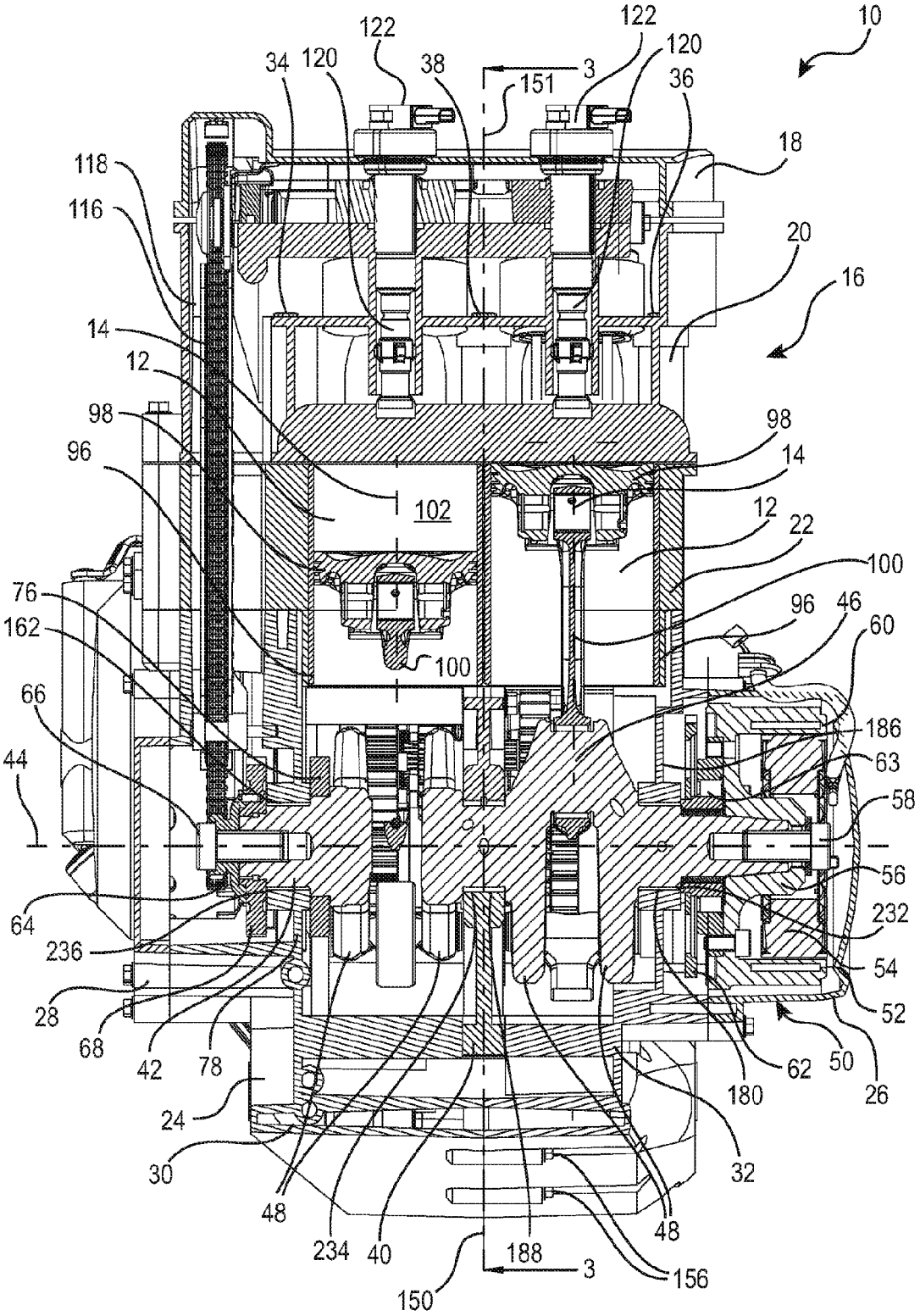
FIG. 2 is a cross-sectional view of the engine of FIG. 1 taken along a plane containing a crankshaft axis and the cylinder axes of the engine.

A crankshaft 42 is rotatably supported inside the crankcase 24 as will be described in more detail below. The crankshaft 42 rotates about a crankshaft axis 44. The crankshaft 42 forms two crank pins 46 (one of which is shown in FIG. 2) that are offset from the crankshaft axis 44. In the present embodiment, the two crank pins 46 are disposed at 90 degrees with respect to each other around the crankshaft axis 44 (see FIG. 7). It is contemplated that the two crank pins 46 could be disposed at other angles with respect to each other, such as, for example, 180 degrees. The crankshaft 42 also forms two counterweights 48 for each crank pin 46. The counterweights 48 are disposed on both sides of their corresponding crankpins 46 along a direction of the crankshaft axis 44 and are disposed on a side of the crankshaft axis 44 opposite to their corresponding crankpins 46.

A magneto 50 (FIG. 2) is disposed in the space formed between the crankcase portion 32 and the magneto cover 26. The magneto 50 includes a rotor 52 and a stator 54. The hub 56 of the rotor 52 is mounted on an end of the crankshaft 42 that protrudes from the crankcase portion 32 and is fastened to the crankshaft 42 by a fastener 58. The rotor 52 has a plurality of permanent magnets (not shown) mounted to a rim 60 thereof. The stator 54 is connected to the magneto cover 46 and is disposed radially between the hub 56 and the rim 60 of the rotor 52. The stator 54 has a plurality of electric coils (no shown). As the crankshaft 42 rotates, the rotor 52 rotates with the crankshaft. Rotation of the rotor 52 causes the permanent magnets to generate a varying magnetic field in the coils of the stator 54, which generates electricity that can be used by various components of the engine 10 or of components of a vehicle in which the engine 10 is used.

A starter gear 62 (FIG. 2) is disposed around the crankshaft 42, between the crankcase portion 32 and the rotor 52. The starter gear 62 is connected to the crankshaft 42 via an overrunning clutch 62. The starter gear 62 is connected to a starter motor (not shown). The starter motor turns the starter gear 62 to make the initial rotations of the crankshaft 42 necessary to cause the initial combustion events to start the engine 10.

A sprocket 64 (FIG. 2) is disposed in the space formed between the crankcase portion 30 and the clutch cover 28. The sprocket 64 is mounted on an end of the crankshaft 42 that protrudes from the crankcase portion 30 and is fastened to the crankshaft 42 by a fastener 66. A gear 68 is disposed around the crankshaft 42, between the crankcase portion 30 and the sprocket 64. The gear 68 is fastened to the sprocket 64 for rotation therewith. The gear 68 engages an input gear (not shown) of a geared transmission (not shown). The transmission is disposed inside a transmission housing 70 (FIG. 3) formed by the crankcase 24. An output shaft 72 (FIG. 1) of the transmission extends through the crankcase portion 32. A sprocket 74 mounted on the end of the output shaft 72 engages a chain (not shown) used to transmit power from the engine 10 to a propelling device, such as wheels, a drive track or a marine propeller, of a vehicle in which the engine 10 is used. It is contemplated that the sprocket 64 could be replaced by a gear or a pulley engaging another gear or a belt respectively. It is also contemplated that the transmission could be disposed outside the engine casing 16 as a separate unit. It is also contemplated that the crankshaft 42 could protrude from the magneto cover 26 or the clutch cover 28 to provide power from the engine 10 to a separate gear transmission, or other power transmission device, such as, for example, a continuously variable transmission.

A gear 76 (FIGS. 2 and 7) is mounted inside the crankcase 24 on the crankshaft 42 for rotation therewith. The gear 76 is disposed between a wall 78 of the crankcase portion 30 and the leftmost counterweight 48 (with reference to FIG. 2) of the crankshaft 42. The gear 76 engages gears 80, 82 mounted on counterbalance shafts 84, 86 respectively, shown in FIG. 7, in order to drive the counterbalance shaft 84, 86. The counterbalance shafts 84, 86 are rotatably supported inside the crankcase 24 as will be described in more detail below. The counterbalance shafts 84, 86 are disposed on both sides of a plane 88 containing the cylinder axes 14 and the crankshaft axis 44. The counterbalance shafts 84, 86 each form two counterweights 90 disposed at 90 degrees from each other. It is contemplated that one or both counterbalance shafts 84, 86 could be omitted. It is also contemplated that the transmission could be driven by a gear on one of the counterbalance shafts 84, 86 instead of by the gear 68. It is also contemplated that the crankshaft 42 could protrude from the crankcase to provide power from the engine 10 to a separate gear transmission, or other power transmission device, such as, for example, a continuously variable transmission.

Figure 3:
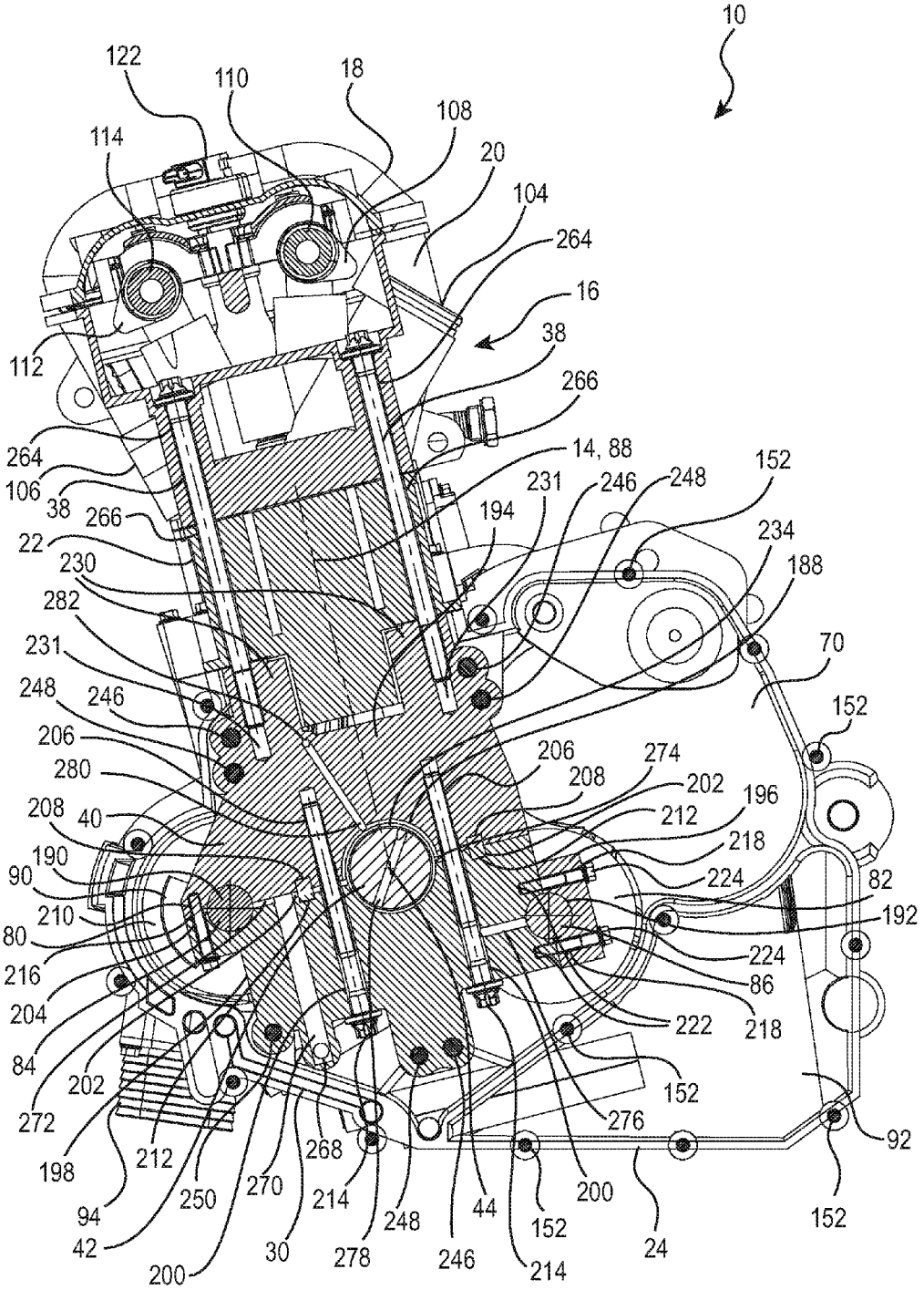
FIG. 3 is a cross-sectional view of the engine of FIG. 1 taken along the line 3-3 of FIG. 2.
Figure 4:
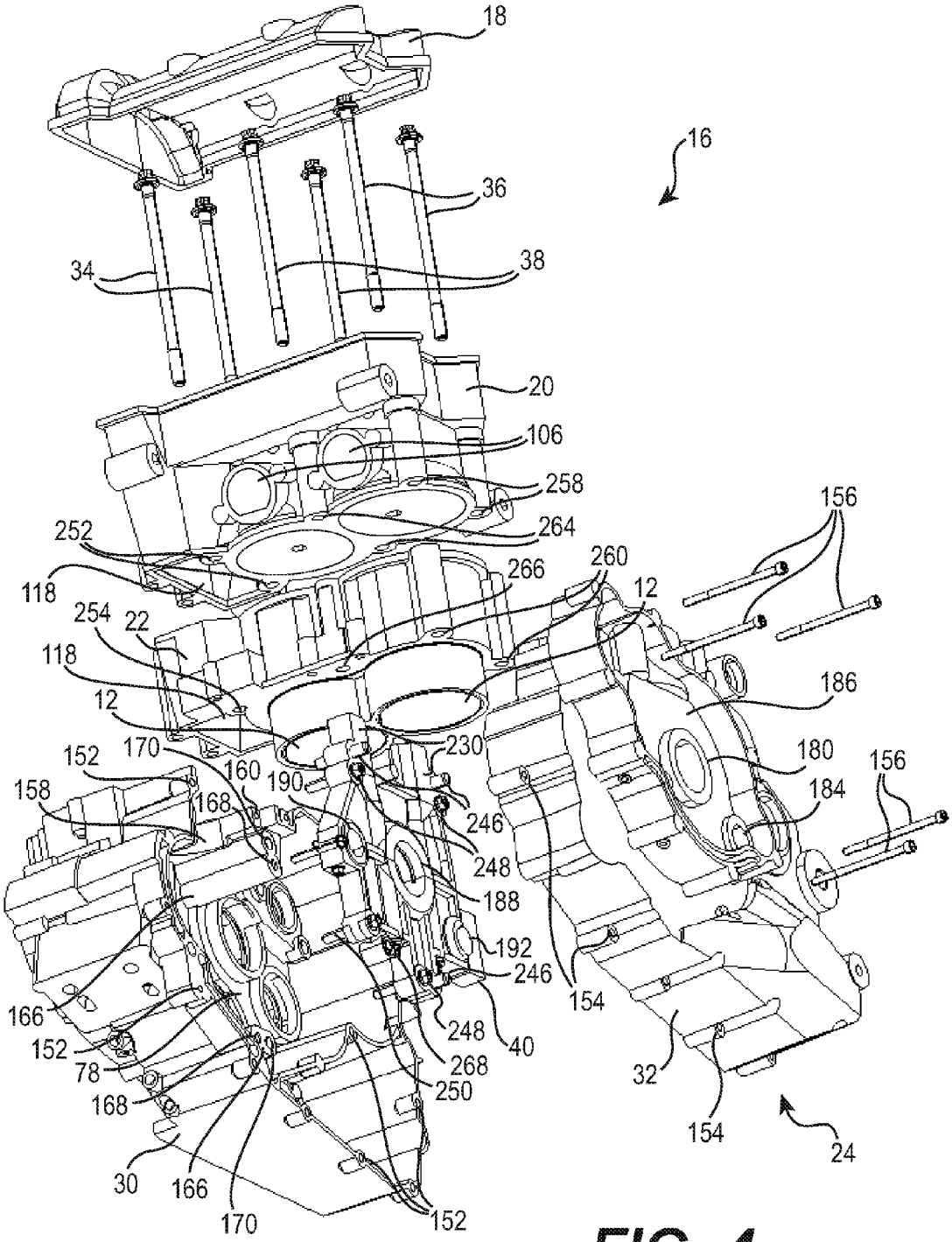
FIG. 4 is an exploded view of some engine casing components and of a crankshaft support of the engine of FIG. 1.

The crankcase 24 also defines an oil tank 92 (FIG. 3). An oil cooler 94 (FIGS. 1 and 3) is mounted to the crankcase portion 30. An oil pump (not shown) disposed in the oil tank 92 pumps oil present in the oil tank 92 to the oil cooler 94 to cool the oil. From the oil cooler 94, the oil pump distributes the oil to various components of the engine 10 via passages formed in the crankcase body 16 and some engine components, some of which will be described below. The oil pump is mechanically driven by the crankshaft 42 via intermediate gears (not shown). It is contemplated that the oil pump could be mechanically driven by another shaft of the engine 10 such as, for example, one of the counterbalance shafts 84, 86, or a shaft of the transmission. It is also contemplated that the oil pump could be an electrical oil pump.

The cylinder block 22 forms the two cylinders 12 therein. Cylinder liners 96 (FIG. 2) are disposed inside the cylinders 12. Pistons 98 are disposed inside the liners 96 to reciprocate inside the cylinders 12 along their respective cylinder axes 14. Each piston 98 is connected to a corresponding crank pin 46 of the crankshaft 42 by a connecting rod 100. Each connecting rod 100 connects to its corresponding piston 98 via a piston pin (not shown). As the pistons 98 reciprocate inside the cylinders 12, the connecting rods 100 cause the crankshaft 42 to rotate. Each piston 98 with its corresponding cylinder liner 96 and the cylinder head 20 defines therebetween a variable volume combustion chamber 102.

The cylinder head 20 defines two air intake ports 104 (FIG. 3) and two exhaust ports 106 (best seen in FIG. 1) (one per cylinder 12). The air intake ports 104 fluidly communicate the combustion chambers 102 with an air intake system (not shown) of the engine 10. Four air intake valves (not shown, two per combustion chamber 102) mounted in the cylinder head 20 open and close the air intake ports 104. It is contemplated that only one or more than two air intake valves could be provided for each combustion chamber 102. The position of the air intake valves is determined by four intake cams 108 mounted on an intake camshaft 110. The intake camshaft 110 is rotationally supported between the cylinder head 20 and the cylinder head cover 18. The exhaust ports 106 fluidly communicate the combustion chambers 102 with an exhaust system (not shown) of the engine 10. Four exhaust valves (not shown, two per combustion chamber 102) mounted in the cylinder head 20 open and close the exhaust ports 106. It is contemplated that only one or more than two exhaust valves could be provided for each combustion chamber 102. The position of the exhaust valves is determined by four exhaust cams 112 mounted on an exhaust camshaft 114. The exhaust camshaft 114 is rotationally supported between the cylinder head 20 and the cylinder head cover 18. As can be seen in FIG. 3, the intake and exhaust camshafts 110, 114 are disposed on opposite sides of the plane 88. Sprockets (not shown) are connected to ends of the intake camshaft 110 and the exhaust camshaft 114 (i.e. the left ends with respect to FIG. 2). The sprockets engage a chain 116. The chain 116 is disposed inside a chain case 118 and is engaged by the sprocket 64 connected to the crankshaft 42. The chain case 118 is defined by the cylinder head cover 18, the cylinder head 20, the cylinder block 22, the crankcase 24 and the clutch cover 28. A chain tensioner (not shown) applies a force to the chain 116 to tension the chain 116. As the crankshaft 42 rotates, the chain 116 drives the intake camshaft 110 and the exhaust camshaft 114. It is contemplated that only one of the camshafts 110, 114 could be driven by the chain 116 and that the other one of the camshafts 110, 114 could be driven by the one of the camshafts 110, 114 via gears mounted on both camshafts 110, 114. It is also contemplated that the intake cams 108 and the exhaust cams 112 could be mounted on a single camshaft.

A stick coil 120 (FIG. 2) is provided for each combustion chamber 102. Each stick coil 120 is connected to a spark plug (not shown). Each spark plug extends through the cylinder block 20 into its corresponding combustion chamber 102. The stick coils 120 and spark plugs are located between the camshafts 110, 114. The stick coils 120 are connected to the electrical system of the engine 10 via connectors 122 provided on the ends of the stick coils 120.

Turning now to FIGS. 2 to 5, the crankcase 24 will be described in more detail. As previously mentioned, the crankcase 24 is made of two crankcase portions 30, 32. The two crankcase portions 30, 32 are joined to each other along a plane 150 (FIG. 2). The plane 150 is perpendicular to the crankshaft axis 44 and to the plane 88. In other words, the crankshaft axis 44 is normal to the plane 150. The plane 150 is located between the two cylinders 12. A plane 151 is also perpendicular to the crankshaft axis 44 and to the plane 88 and passes through the center of a central bearing 234 (described below) of the crankshaft 42 and the crankshaft support 40. In the present embodiment, the planes 150, 151 are coplanar, however it is contemplated that the plane 151 could be offset from and parallel to the plane 150 depending on a position of the central bearing 234 relative to the plane 150. It is contemplated that some portions of the crankcase portions 30, 32 could be joined along planes that are offset from and/or skewed relative to the plane 150.

The crankcase portion 30 has a plurality of threaded apertures 152 defined along the edge where it is joined to the crankcase portion 32. The crankcase portion 32 has a plurality of apertures 154 extending therethrough and in alignment with the apertures 152 of the crankcase portions 30. Threaded fasteners 156 are inserted through the apertures 154 and into the apertures 152 to fasten the crankcase portion 30 to the crankcase portion 32 along the plane 150. Note that for clarity only some of the apertures 152, 154 and fasteners 156 have been labelled in the figures.

The crankcase portion 30 defines a U-shaped recess 158 to receive a lower portion of a corresponding one of the cylinders 12 (i.e. the left cylinder 12 with respect to FIG. 2). L-shaped notches 160 are formed between the edge of the crankcase portion 30 and the U-shaped recess 158. The L-shaped notches 160 receive a portion of an upper portion of the crankshaft support 40.

The crankcase portion 30 defines a crankshaft support aperture 162 (FIG. 2), a counterbalance shaft support aperture (not shown) and another counterbalance shaft support aperture 164 (FIG. 5) in the wall 78 thereof. As can be seen in FIG. 2 for the crankshaft support aperture 162, the portions of the wall 78 around the apertures 162, 164 are thicker than the other portions of the wall 78.

The crankcase portion 30 has three posts 166 (only two of which are shown) extending from the wall 78 toward the plane 150. Each of the posts 166 has a threaded aperture 168 and a pin receiving aperture 170. The crankcase also has a threaded aperture 172. The threaded apertures 168 and 172 are used to fasten the crankshaft support 40 to the crankcase portion 40 as will be described below. The pin receiving apertures 170 assist in the alignment of the two crankcase portions 30, 32 and of the crankshaft support 40 during assembly as will be described below. A lubrication aperture 174 is also defined in the crankcase portion 30 to supply lubricant to the crankshaft support 40 as will be described below.

The crankcase portion 32 defines a U-shaped recess 176 to receive a lower portion of a corresponding one of the cylinders 12 (i.e. the right cylinder 12 with respect to FIG. 2). L-shaped notches 178 are formed between the edge of the crankcase portion 32 and the U-shaped recess 176. The L-shaped notches 178 receive a portion of an upper portion of the crankshaft support 40.

Figure 5:
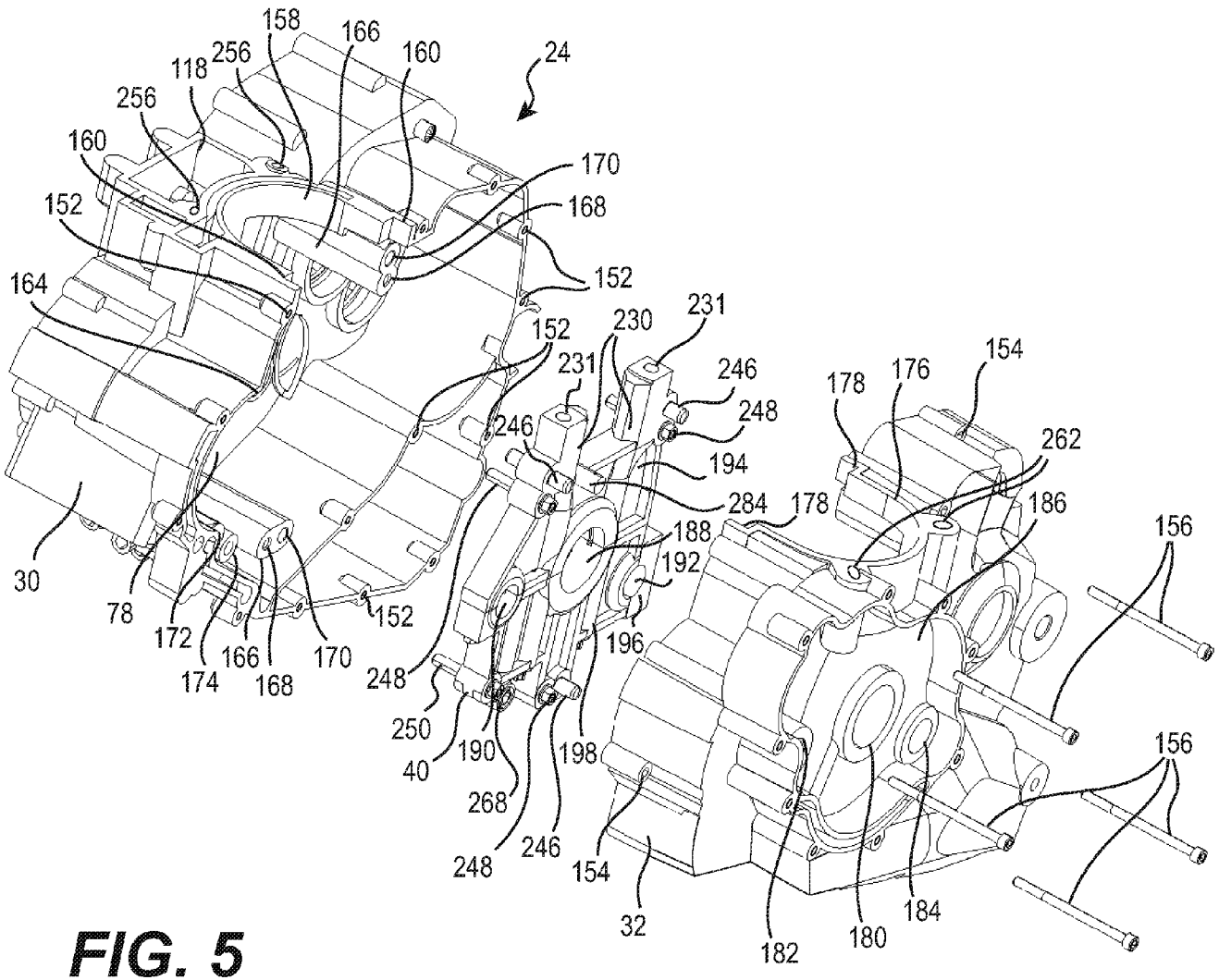
FIG. 5 is an exploded view of a crankcase and the crankshaft support of the engine of FIG. 1.

As can be seen in FIG. 5, the crankcase portion 32 defines a crankshaft support aperture 180, a counterbalance shaft support aperture 182 and a counterbalance shaft support aperture 184 in a wall 186 thereof. The crankshaft support aperture 180 is coaxial with the crankshaft support aperture 162 of the crankcase portion 30. The counterbalance shaft support aperture 184 is coaxial with the counterbalance shaft support aperture 164 of the crankcase portion 30. The counterbalance shaft support aperture 182 is coaxial with the other counterbalance shaft support aperture of the crankcase portion 30. The portions of the wall 186 around the apertures 180, 182, 184 are thicker than the other portions of the wall 186.

The crankcase portion 32 has three posts (not shown) extending from the wall 186 toward the plane 150. Each of the posts has a pin receiving aperture (not shown) similar to and coaxial with a corresponding pin receiving aperture 170 of the posts 166 of the crankcase portion 30. The pin receiving apertures assist in the alignment of the two crankcase portions 30, 32 and of the crankshaft support 40 during assembly as will be described below. A lubrication aperture (not shown) similar to and coaxial with the lubrication aperture 174 is also defined in the crankcase portion 32 to supply lubricant to the crankshaft support 40 as will be described below.

Turning now to FIGS. 3 and 5 to 7, the crankshaft support 40 will be described in more detail. As can be seen in FIG. 5, the crankshaft support 40 defines a crankshaft support aperture 188, a counterbalance shaft support aperture 190 and a counterbalance shaft aperture 192. The crankshaft support aperture 188 is coaxial with the crankshaft support aperture 162 of the crankcase portion 30 and the crankshaft support aperture 180 of the crankcase portion 32. The counterbalance shaft support aperture 192 is coaxial with the counterbalance shaft support aperture 164 of the crankcase portion 30 and the counterbalance shaft aperture 184 of the crankcase portion 32. The counterbalance shaft support aperture 190 is coaxial with the other counterbalance shaft support aperture of the crankcase portion 30 and the counterbalance shaft support aperture 182 of the crankcase portion 32.

Figure 6:
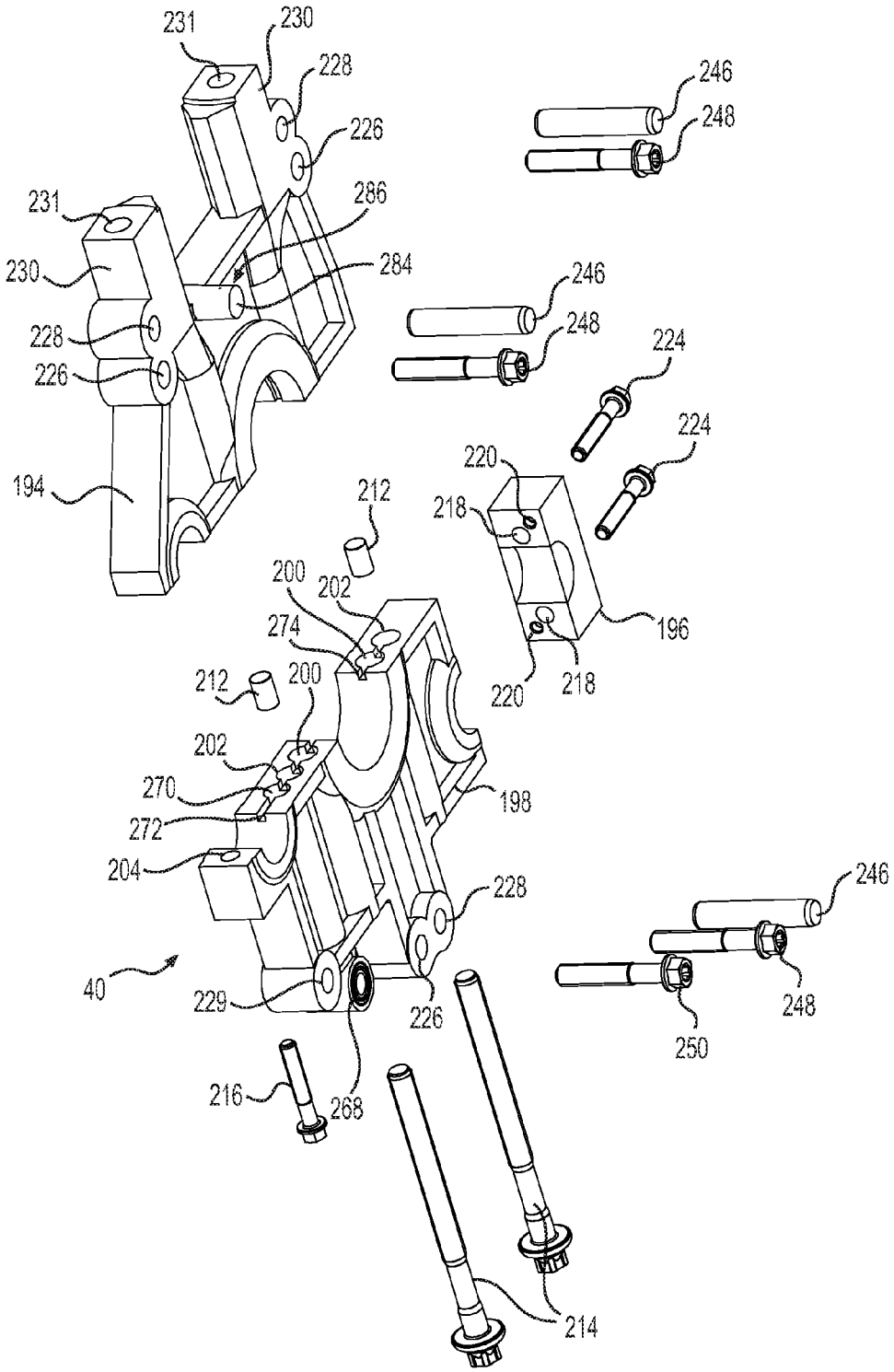
FIG. 6 is an exploded view of the crankshaft support of the engine of FIG. 1.

As best seen in FIG. 6, the crankshaft support 40 is made of three parts 194, 196, and 198. The part 194 defines half of each of the apertures 188 and 190. The part 196 defines half of the aperture 192. The part 198 defines the other half of each of the aperture 188, 190, 192. The parts 194 and 198 are joined along a plane containing the crankshaft axis 44 and perpendicular to the plane 88 (see FIG. 3). The parts 196, 198 are joined about a plane parallel to the plane 88 (see FIG. 3). It is contemplated that the plane along which parts 196, 198 are joined could be angled relative to the plane 88. It is contemplated that the crankshaft support 40 could be made of two or more than three parts.

The part 198 defines two apertures 200 extending therethrough on both sides of the aperture 188 and two apertures 202 disposed laterally outward of the apertures 200. The part 198 also defines an aperture 204 therethrough between the aperture 190 and the side of the part 198. As can be seen in FIG. 3, the part 194 defines two threaded apertures 206 in alignment with the apertures 200, two apertures 208 in alignment with the apertures 202 and a threaded aperture 210 in alignment with the aperture 204. The apertures 200, 202, 204, 206, 208 and 210 are perpendicular to the crankshaft axis 44 and parallel to the plane 88. It is contemplated that the apertures 200, 202, 204, 206, 208 and 210 could not be parallel to the plane 88. To fasten the part 194 to the part 198, pins 212 are inserted in the apertures 202 or 208 and the parts 194, 198 are brought together such that the pins 212 are in the apertures 202 and 208, thus aligning the parts 194, 198 with each other. Two threaded fasteners 214 are then inserted through the apertures 200 and fastened into the apertures 206. A threaded fastener 216 is then inserted through the aperture 204 and fastened into the aperture 210. It is contemplated that the pins 212 and/or the fastener 216 and their corresponding apertures could be omitted. It is also contemplated that the fastener 216 could be fastened before the fasteners 214.

The part 196 defines two apertures 218 extending therethrough on both sides of the aperture 192 and two apertures 220 disposed diagonally relative to the apertures 218. As can be seen in FIG. 3, the part 198 defines two threaded apertures 222 in alignment with the apertures 218. The part 198 also defines two apertures (not shown) in alignment with the apertures 220. The apertures 218, 220 and 222 and the apertures in the part 198 in alignment with the apertures 220 are normal to the plane 88. To fasten the part 196 to the part 198, pins (not shown) are inserted in the apertures 220 or the corresponding apertures in the part 198 and the parts 196, 198 are brought together such that the pins are in the apertures 202 and the corresponding apertures in the part 198, thus aligning the parts 196, 198 with each other. Two threaded fasteners 224 are then inserted through the apertures 218 and fastened into the apertures 222. It is contemplated that the pins 212 and their corresponding apertures could be omitted.

As can be seen in FIG. 6, the part 194 defines two apertures 226 and two pin receiving apertures 228. The part 198 defines an aperture 226, a pin receiving aperture 228 and an aperture 229. The apertures 226, 228 and 229 are parallel to the crankshaft axis 44. The apertures 226 are coaxial with the threaded apertures 168 of the posts 166 of the crankcase portion 30. The aperture 229 is coaxial with the threaded aperture 172 of the crankcase portion 30. The pin receiving apertures 228 are coaxial with the pin receiving apertures 170 of the posts 166 of the crankcase portions 30 and 32. The apertures 226, 229 are used to fasten the crankshaft support 40 to the crankcase portion 30 as will be described below. The pin receiving apertures 228 are used to align the crankshaft support 40 with the crankcase portions 30 and 32.

The part 194 also has two posts 230 disposed on both sides of the plane 88. The posts 230 each define a threaded aperture 231. The threaded apertures 231 are parallel to the plane 88 and perpendicular to the crankshaft axis 44. As will be described below, the apertures 231 are used to fasten the crankshaft support 40 to the cylinder block 22 and the cylinder head 20. When the engine casing 16 is assembled, a portion of the cylinder block 22 is received between the posts 230 as can be seen in FIG. 3. As can also be seen in FIG. 3, the apertures 202, 206 are closer to the plane 88 than the apertures 231.

Figure 7:
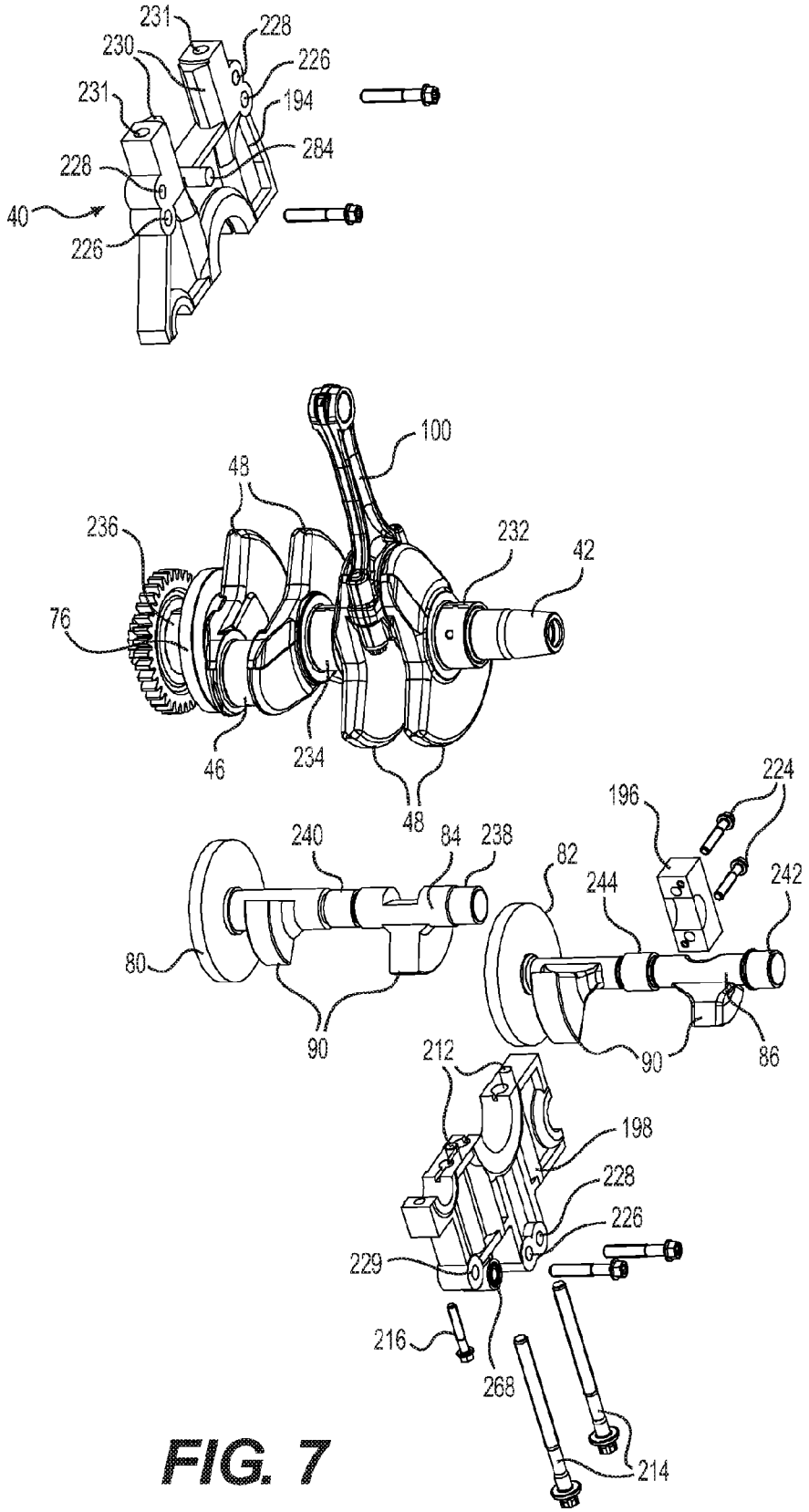
FIG. 7 is an exploded view of the crankshaft support of the engine of FIG. 1 and of associated shafts.

Turning now to FIG. 7, additional details regarding the crankshaft 42 and the counterbalance shafts 84, 86 will be provided.

A two-piece plain bearing 232 is provided over one end portion of the crankshaft 42. A two-piece plain bearing is similar to a bushing made of two halves called shells. Another two-piece plain bearing 234 is provided over a central portion of the crankshaft 42. Another two-piece plain bearing 236 is provided over the other end portion of the crankshaft 42. The bearings 232, 234, 236 are made of brass, but other materials are contemplated. It is also contemplated that the plain bearings 232, 234, 236 could be replaced by other types of bearings, such as roller bearings. It is also contemplated that the plain bearings 232, 234, 236 could be omitted such that the surfaces of the crankshaft 42 in contact with the apertures in which the crankshaft 42 is received (i.e. journals) together with these apertures form journal bearings.

The counterbalance shaft 84 forms a journal 238 at one end portion thereof, another journal 240 at a center thereof and another journal at the other end portion thereof (not shown, located behind the gear 80 in FIG. 7). These journals together with the apertures in which they are located, as described below, form journal bearings. It is contemplated that two-piece plain bearings or other types of bearings could be provided between the counterbalance shaft 84 and the apertures in which it is rotationally supported.

Similarly, the counterbalance shaft 86 forms a journal 242 at one end portion thereof, another journal 244 at a center thereof and another journal at the other end portion thereof (not shown, located behind the gear 82 in FIG. 7). These journals together with the apertures in which they are located, as described below, form journal bearings. It is contemplated that two-piece plain bearings or other types of bearings could be provided between the counterbalance shaft 86 and the apertures in which it is rotationally supported.

Turning now to FIGS. 2 to 5 and 7, the assembly of the crankshaft 42, counterbalance shafts 84, 86, and the crankshaft support 40 in the crankcase 24 and the assembly of the engine casing 16 will be described.

First, the crankshaft 42 and counterbalance shafts 84, 86 are connected to the crankshaft support 40. To do so, the bearing 234 of the crankshaft 42 and the journal 240 of the counterbalance shaft 84 are disposed in the halves of the apertures 188, 190 respectively provided by the part 198 of the crankshaft support 40. The part 194 of the crankshaft support 40 is then fastened to the part 198 as described above such that the bearing 234 and journal 240 are rotationally supported in the apertures 188, 190 respectively. The journal 244 of the counterbalance shaft 86 is disposed in the half of the aperture 192 provided by the part 198 of the crankshaft support 40. The part 196 of the crankshaft support 40 is then fastened to the part 198 as described above such that the journal 244 is rotationally supported in the aperture 192. It is contemplated that the counterbalance shaft 86 could be connected to the crankshaft support 40 before the crankshaft 42 and counterbalance shaft 84.

Three pins 246 are then inserted in the three pin receiving apertures 228 of the crankshaft support 40 such that they extend from both sides of the crankshaft support 40. It is contemplated that more or less than three pins 246, with a corresponding number of apertures 228 could be provided.

The assembly of the crankshaft 42, counterbalance shafts 84, 86 and crankshaft support 40 is then mounted to the crankcase portion 30. The assembly is inserted into the crankcase portion 30 such that the bearing 236 of the crankshaft 42 is received in crankshaft support aperture 162, the end journal of the counterbalance shaft 86 is received in the counterbalance shaft support aperture 164, and the end journal of the counterbalance shaft 84 is received in the other counterbalance shaft support aperture of the crankcase portion 30. As would be understood, the sprocket 64 and gear 68 are not mounted to the crankshaft 42 when this step is performed. The crankshaft support 40 is then positioned such that the pins 246 are received in the apertures 170 defined in the crankcase portion 30 and the posts 230 of the crankcase support 40 are received in the L-shaped notches 160 of the crankcase portion 30. It is contemplated that the pins 246 could first be inserted in the apertures 170 and the crankshaft support 40 would then be positioned such that the pins 246 are received in the apertures 228.

Fasteners 248 are then inserted through the apertures 226 of the crankshaft support 40 and fastened into the threaded apertures 168 of the crankcase portion 30. A fastener 250 is also inserted through the aperture 229 of the crankshaft support 40 and fastened into the threaded aperture 172 of the crankcase portion 30. The fasteners 248, 250 are parallel to the crankshaft axis 44 and normal to the plane 151. It is contemplated that more or less fasteners 248, 250, with a corresponding number of apertures 226, 168, 229, 172, could be provided. It is also contemplated that the fasteners 248, 250 could be used to fasten the crankshaft support 40 to apertures provided in the crankcase portion 32.

The crankcase portion 32 is then inserted over the crankshaft 42 and counterbalance shafts 84, 86 such that the bearing 232 of the crankshaft 42 is received in the crankshaft support aperture 180, the journal 238 of the counterbalance shaft 84 is received in the counterbalance shaft support aperture 182, and the journal 242 of the counterbalance shaft 86 is received in the counterbalance shaft support aperture 184. The pins 246 are also received in the pin receiving apertures of the crankcase portion 32. The posts 230 are also received in the L-shaped notches 178 of the crankcase portion 32. The top of the posts 230 is level with the adjacent portions of the crankcase portions 30, 32. The fasteners 156 are then inserted through the apertures 154 of the crankcase portion 32 and fastened into the threaded apertures 152 of the crankcase portion 30, thereby fastening the two crankcase portions 30, 32 together along the plane 150 to form the crankcase 24.

In order to ensure that the crankcase portions 30, 32 and the crankshaft support fit together properly, following the manufacturing of the crankcase portions 30, 32 and the crankshaft support 40, the crankcase portions 30, 32 and the crankshaft support 40 are assembled together as described above, but without the crankshaft 42 and the counterbalance shafts 84, 86. Once assembled, the top of the crankcase portions 30, 33 and of the posts 230 of the crankshaft support are machined such that they are leveled each other. The crankshaft support aperture 188, the crankshaft support aperture 162 of the crankcase portion 30 and the crankshaft support aperture 180 of the crankcase portion 32 are machined to ensure they are aligned and coaxial. The counterbalance shaft support aperture 192, the counterbalance shaft support aperture 164 of the crankcase portion 30 and the counterbalance shaft aperture 184 of the crankcase portion 32 are machined to ensure they are aligned and coaxial. Similarly, the counterbalance shaft support aperture 190, the other counterbalance shaft support aperture of the crankcase portion 30 and the counterbalance shaft support aperture 182 of the crankcase portion 32 are machined to ensure they are aligned and coaxial.

Once the crankcase portions 30, 32, the crankshaft support 40, the crankshaft 42 and the counterbalance shafts 84, 86 are assembled as described above, the cylinder block 22 is then positioned over the crankcase 24 such that the lower portion of the cylinders 12 is received in the U-shaped portions 158, 176 of the crankcase portions 30, 32 and between the posts 230 of the crankcase support 40. The cylinder head 20 is then disposed over the cylinder block 22. The threaded fasteners 34 are inserted through apertures 252 (FIG. 4) in the cylinder head 20, apertures 254 (FIG. 4, only one shown) in the cylinder block 22, and threaded into threaded apertures 256 (FIG. 5) of the crankcase portion 30. The threaded fasteners 36 are inserted through apertures 258 (FIG. 4) in the cylinder head 20, apertures 260 (FIG. 4) in the cylinder block 22, and threaded into threaded apertures 262 (FIG. 5) of the crankcase portion 32. As best seen in FIG. 3, the threaded fasteners 38 are inserted through apertures 264 in the cylinder head 20, apertures 266 in the cylinder block 22, and threaded into the threaded apertures 231 of the crankshaft support 40. It is contemplated that the order in which the fasteners 34, 36, 38 are fastened could be different from the order described above. The fasteners 34 and 36 are parallel to the planes 88, 150 and the cylinder axes 14 and perpendicular to the crankshaft axis 42. The fasteners 38 are parallel to the plane 88 and the cylinder axes 14, are disposed in the plane 151 and are perpendicular to the crankshaft axis 42. The fasteners 214 are also parallel to the plane 88 and the cylinder axes 14, are disposed in the plane 151 and are perpendicular to the crankshaft axis 42. It is contemplated that more fasteners could be used to fasten the cylinder head 20, cylinder block 22 and crankcase 24 (including the crankshaft support 40) together. It is contemplated that a first set of fastener could be used to connect the cylinder block 22 to the crankcase 24 and the crankshaft support 40 and that a second set of fasteners could be used to fasten the cylinder head 20 to the cylinder block 22. The cylinder head cover 18 is then fastened to the cylinder head 22. It is contemplated that the fasteners 34, 36, 38, 214 (and their associated apertures) could not be parallel to the plane 88. For example, the fasteners 34, 36, 38, 214 could be perpendicular to the crankshaft axis 44 and be disposed at an angle between 0 and 45 degrees to the plane 88.

As would be understood, many components of the engine 10, such as the pistons 98 and the camshafts 110, 114 for example, have to be assembled in the engine casing 16 before the engine casing 16 is fully assembled as described above. As such, these assembly steps have been omitted for simplicity.

Due to their orientations, the fastener 38 and 214 reduce the amount of torque transferred to the crankcase 24 by forces transferred from the crankshaft 42 to the crankshaft support 40 during operation of the engine.

Turning back to FIGS. 2 and 6, a portion of the lubrication system of the engine 10 will be described. Lubricant is supplied to a lubricant inlet 268 defined in the part 198 of the crankshaft support 40 by the oil pump via the lubrication aperture 174 defined in the crankcase portion 30 and the corresponding lubricant aperture defined in the crankcase portion 32. Lubricant then flows up a passage 270 defined in the part 198 and enters a passage 272 defined between the parts 194 and 198. A portion of the lubricant flows in the passage 272 toward the aperture 190 to lubricate the journal bearing formed by the journal 240 of the counterbalance shaft 84 and the aperture 190. Another portion of the lubricant flows in the passage 272 toward the aperture 188 to lubricate the bearing 234 of the crankshaft 42. From there, some of the lubricant flows in a passage 274 defined between the parts 194 and 198, goes down the aperture 200 around the fastener 214, enters a passage 276 and flows toward the aperture 192 to lubricate the journal bearing formed by the journal 244 of the counterbalance shaft 86 and the aperture 192. A portion of the lubricant lubricating the bearing 234 of the crankshaft 42 flows into a passage 278 defined through the crankshaft 42 and the bearing 234. From the passage 278, some lubricant flows in passages (not shown) formed in the crankshaft 42 to lubricate one or more of the crank pins 46. From the passage 278 in the crankshaft 42, some lubricant also flows up a passage 280 defined in the part 194 of the crankshaft support 40. The passage 280 connects to a passage 282 (FIG. 3) formed in two projections 284 (only one of which is shown in FIG. 6) defined by the part 194 of the crankshaft support 40. The projections 284 extend on both sides of the crankshaft support 40. Each projection 284 has a small spray aperture 286 on a top thereof that communicates with the lubricant passage 282. Lubricant from the passage 282 is sprayed up into both cylinders 12 via the spray apertures 286. The sprayed lubricant cools the pistons 98 and lubricates the piston pins (not shown) connecting the pistons 98 to the connecting rods 100. It is contemplated that the spray apertures 286 could be replaced by nozzles mounted to the projections 284 and communicating with the lubricant passage 282.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. An internal combustion engine comprising:

a crankcase having a first crankcase portion fastened to a second crankcase portion, the first crankcase portion being joined to the second crankcase portion along a first plane, the first crankcase portion having a first wall defining a first crankshaft support aperture, the second crankcase portion having a second wall defining a second crankshaft support aperture;

a crankshaft having a first end portion, a second end portion and a central portion, the crankshaft being rotatably supported inside the crankcase, the crankshaft being rotatable about a crankshaft axis, the crankshaft axis being normal to the first plane, the first end portion being received in the first crankshaft support aperture, the second end portion being received in the second crankshaft support aperture;

a cylinder block fastened to the crankcase, the cylinder block defining two cylinders, each of the two cylinders having a cylinder axis;

two pistons operatively connected to the crankshaft, the two pistons being disposed in the two cylinders;

a cylinder head fastened to the cylinder block, the cylinder block being disposed between the cylinder head and the crankcase;

a crankshaft support defining a third crankshaft support aperture, the third crankshaft support aperture being coaxial with the first crankshaft support aperture, the second crankshaft aperture and the crankshaft axis, the central portion of the crankshaft being received in the third crankshaft support aperture; and at least one fastener fastening the crankshaft support to the cylinder block, the at least one fastener being perpendicular to the crankshaft axis and being disposed in a second plane, the second plane being one of coplanar with and parallel to the first plane.

2. The engine of claim 1, wherein the at least one fastener fastens the crankshaft support to the cylinder block and the cylinder head.

3. The engine of claim 1, wherein the at least one fastener is parallel to a third plane, the third plane containing the cylinder axes and the crankshaft axis.

4. The engine of claim 1, wherein the at least one fastener is two fasteners disposed on both sides of a third plane, the third plane containing the cylinder axes and the crankshaft axis.

5. The engine of claim 1, wherein the first plane is disposed between the two cylinders.

6. The engine of claim 1, wherein the second plane is disposed between the two cylinders.

7. The engine of claim 1, wherein the second plane is coplanar with the first plane.

8. The engine of claim 1, further comprising at least one lubrication passage defined in the crankshaft support.

9. The engine of claim 8, wherein the crankshaft support defines at least one spray aperture fluidly communicating with the at least one lubrication passage, the at least one spray aperture being adapted to spray lubricant on a least one of the two pistons.

10. The engine of claim 1, wherein the crankshaft support has a first part defining a portion of the third crankshaft support aperture and a second part defining another portion of the third crankshaft support aperture; and wherein the first part is fastened to the second part.

11. The engine of claim 10, wherein the at least one fastener is at least one first fastener; and the engine further comprising at least one second fastener fastening the first part to the second part, the at least one second fastener being perpendicular to the crankshaft axis and being disposed in the second plane.

12. The engine of claim 11, wherein the first part is disposed between the second part and the cylinder block; and wherein the at least one second fastener is inserted through the second part and into the first part.

13. The engine of claim 12, wherein the at least one first fastener is inserted into the first part and is not inserted into the second part.

14. The engine of claim 11, wherein the at least one second fastener is parallel to a third plane, the third plane containing the cylinder axes and the crankshaft axis.

15. The engine of claim 14, wherein the at least one first fastener is parallel to the third plane.

16. The engine of claim 15, wherein the at least one first fastener is two first fasteners disposed on both sides of the third plane;

wherein the at least one second fastener is two second fasteners disposed on both sides of the third plane; and wherein the two second fasteners are closer to the third plane than the two first fasteners.

17. The engine of claim 11, wherein the at least one second fastener is two second fasteners disposed on both sides of the third crankshaft support aperture.

18. The engine of claim 1, wherein:

the first crankcase portion defines a first counterbalance shaft support aperture in the first wall, the second crankcase portion defines a second counterbalance shaft support aperture in the second wall, the crankshaft support defines a third counterbalance shaft support aperture, the engine further comprising:

a counterbalance shaft having a first end portion, a second end portion and a central portion, the counterbalance shaft being rotatably supported inside the crankcase, the first end portion of the counterbalance shaft being received in the first counterbalance shaft support aperture, the second end portion of the counterbalance shaft being received in the second counterbalance shaft support aperture, and the central portion of the counterbalance shaft being received in the third counterbalance shaft support aperture.

19. The engine of claim 18, wherein:

the counterbalance shaft is a first counterbalance shaft, the first crankcase portion defines a fourth counterbalance shaft support aperture in the first wall, the second crankcase portion defines a fifth counterbalance shaft support aperture in the second wall, the crankshaft support defines a sixth counterbalance shaft support aperture, the engine further comprising:

a second counterbalance shaft having a first end portion, a second end portion and a central portion, the second counterbalance shaft being rotatably supported inside the crankcase, the first end portion of the second counterbalance shaft being received in the fourth counterbalance shaft support aperture, the second end portion of the second counterbalance shaft being received in the fifth counterbalance shaft support aperture, and the central portion of the second counterbalance shaft being received in the sixth counterbalance shaft support aperture.

20. The engine of claim 19, wherein the first and second counterbalance shafts are disposed on opposite sides of the third plane.

* * * * *